US006427558B1

(12) United States Patent
DeLand

(10) Patent No.: US 6,427,558 B1
(45) Date of Patent: Aug. 6, 2002

(54) REACTION CAM

(75) Inventor: James A. DeLand, Bothell, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/590,242

(22) Filed: Jun. 8, 2000

(51) Int. Cl.[7] ..... B25B 9/00
(52) U.S. Cl. ..... 81/13
(58) Field of Search ..... 81/13, 55

(56) References Cited

U.S. PATENT DOCUMENTS

| | | | | |
|---|---|---|---|---|
| 1,431,832 A | * | 10/1922 | Mills et al. | 81/13 |
| 3,706,244 A | | 12/1972 | Wilmeth | 81/57.32 |
| 3,955,447 A | | 5/1976 | Parker | 81/57.39 |
| 4,027,560 A | | 6/1977 | Parker | 81/57.39 |
| 4,899,625 A | * | 2/1990 | Lymburner | 81/13 |
| 4,914,989 A | * | 4/1990 | Hendricks et al. | 41/462 |
| 5,954,466 A | * | 9/1999 | Coffey et al. | 411/119 |

* cited by examiner

*Primary Examiner*—Joseph J. Hail, III
*Assistant Examiner*—David B. Thomas
(74) *Attorney, Agent, or Firm*—Harness, Dickey & Pierce P.L.C.

(57) ABSTRACT

A reaction cam system for use as a release system in a torquing process. The reaction cam applies a reaction force to a backup wrench coupled between a head of a fastener and an adjacent component. The reaction cam is positioned against the backup wrench and has an inner sleeve removably coupled to a head of the fastener. An eccentrically mounted cam housing is rotatably supported about the inner sleeve. The cam housing is positioned prior to the torquing process being initiated such that a high point of the housing faces a portion of the backup wrench. After the torquing process is complete and the backup wrench is forced tightly into contact with the cam housing, the cam housing can be rotated such that a gap is created between the backup wrench and reaction cam. The reaction cam then can be easily removed from the adjacent component and the backup wrench easily removed from the fastener.

14 Claims, 2 Drawing Sheets

REACTION CAM

TECHNICAL FIELD

This invention relates to a release system for loads which develop during a torquing process on a backup wrench coupled between a fastener and an adjacent component disposed within a surface, and more particularly to a reaction cam adapted for use with a backup wrench during torquing processes.

BACKGROUND ART

A typical torquing process involves torquing a nut located on an end of a threaded fastener with a torque wrench while a head portion of the fastener is grasped with a first end of a backup wrench. The backup wrench is oriented such that a second end thereof is located proximate to an adjacent bolt or component. The first end of the backup wrench holds the head portion of the fastener while a torquing force is applied to the nut. The second end of the backup wrench is allowed to react against the head of an adjacent component to thereby provide a reaction force. The adjacent component typically also has a standard socket placed on the head thereof. A plastic wedge is positioned between the socket and the backup wrench such that the second end of the backup wrench reacts directly against the plastic wedge. Once the nut has been sufficiently torqued, the plastic wedge is removed (typically knocked out with a hammer and flat blade screwdriver) from its tightly held position between the socket and the backup wrench to release the load being applied by the backup wrench to the adjacent component.

Some fasteners, however, are located in configurations which make it difficult or impossible to easily use the above-described torquing process. For example, when using adjacent component heads on pipe flange fittings or rear spar terminal fitting bolts to provide the fixed, reacting element, it can be difficult, because of space constraints, to knock out the plastic wedge after the torquing force has been applied and the backup wrench is held tightly against such reacting element. In addition, the removal of the tightly held plastic wedge in the typical torquing process may damage the reacting element due to the difficulty of removing the plastic wedge. Furthermore, the use of multiple components to form the reacting element, such as a socket and a plastic wedge, is undesirable because such components can be easily lost in the work environment. This can be particularly problematic in machinery, engines and other apparatus with moving parts which are highly susceptible to jamming or damage from extraneous parts.

It is therefore a principal object of the present invention to provide a reaction cam that is capable of operating in configurations where it is difficult to use a conventional plastic wedge between an adjacent socket and backup wrench as the means to remove the reaction force applied to the backup wrench.

It is another object of the present invention to provide a reaction cam which does not damage the adjacent component with which it is engaged when a backup wrench is utilized in a torquing process.

It is another object of the present invention to provide a reaction cam which does not have multiple pieces which can easily be separated and lost in the work environment.

SUMMARY OF THE INVENTION

The above and other objects are provided by a reaction cam in accordance with a preferred embodiment of the present invention, and a method of using same. The reaction cam is used on a fixed component disposed adjacent to a threaded fastener being torqued. The reaction cam provides the reaction force on a backup wrench as a torque is applied to one element of the threaded fastener, while the backup wrench is coupled to a second element of the fastener. A principal feature of the reaction cam is that the reaction cam protects the adjacent component by receiving the force applied by the backup wrench that abuts the reaction cam, while allowing one component of the reaction cam to be easily moved after the torquing process is completed, to thus allow the reaction cam and the backup wrench to both be easily removed.

The reaction cam includes an inner sleeve disposed within a cam housing having an eccentric opening. The inner sleeve is placed on the head of the adjacent component. The cam housing is rotatably supported about the inner sleeve. The cam housing includes a drive opening which can be engaged with a drive element of a conventional socket wrench and rotated.

Under loaded conditions caused by torquing the nut of the fastener, the backup wrench abuts and applies a force to the cam housing. The reaction cam system applies a counter-acting reaction force to the backup wrench which allows the nut to be torqued without the threaded fastener turning. Under a fully loaded condition, the drive opening in the cam housing can be easily engaged with a drive element of a conventional socket wrench and rotated. The eccentric opening causes the cam housing to move eccentrically about the inner sleeve. This allows a small gap to be created between the backup wrench and reaction cam, and the reaction force applied by the system is thus removed. The backup wrench can then be easily removed from the fastener head. The reaction cam of the present invention can then also be easily removed from the adjacent component. Furthermore, the reaction cam of the present invention protects the adjacent component and fittings from damage.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
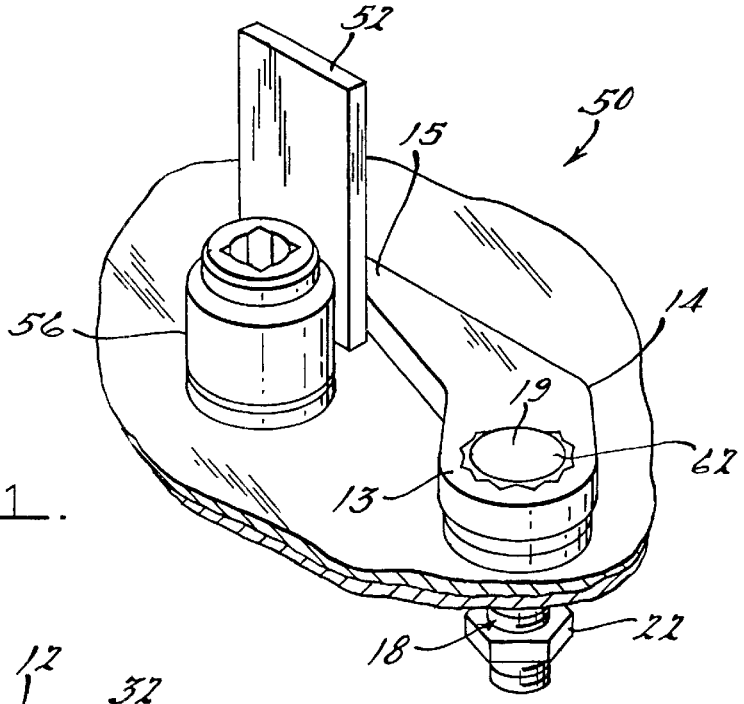
Prior Art FIG. 1.
FIG. 1 is a perspective view showing a typical load release arrangement used with a backup wrench during a torquing process.

Referring to FIG. 1, there is shown a prior art torquing system 50 incorporating a plastic wedge 52, a backup wrench 14, a fastener 18 and a standard socket 56. The standard socket 56 is coupled to an adjacent component head (hidden within the socket 56). A nut 22 associated with the fastener 18 is in an untightened position. A first end 13 of the backup wrench 14 is coupled to a fastener head 19 of fastener 18 and is forced against the plastic wedge 52 as the nut 22 is torqued into a tightened position with a torque wrench (not shown). As the nut 58 is torqued and tightens, the backup wrench 14 maintains the head 62 of the fastener 60 stationary while applying a load via a second end 15 to the plastic wedge 52 and the socket 56. The socket 56 and wedge 52 apply a counter-acting reaction force on the backup wrench 14. After the nut 22 is tightened (i.e., torqued) to a desirable force, then the plastic wedge 52 is removed from between the standard socket 58 and the backup wrench 14. Since the plastic wedge 52 is effectively being "squeezed") very tightly between the socket 56 and the second end 15 of the backup wrench 14, it cannot be easily removed. Likewise, the socket 56 cannot be easily removed in view of the force being applied to it by the second end 15 of the backup wrench 14. Accordingly, it is usually necessary to forcibly "knock" the plastic wedge 52 out with a hammer, or with a hammer and screwdriver, in order to allow the socket 56 to be removed from the adjacent component. As can be appreciated, this can be quite difficult in applications where space restricts the access to the plastic wedge 52 or makes it difficult or impossible to grasp or strike the plastic wedge 52 to remove it.

Figure 2:
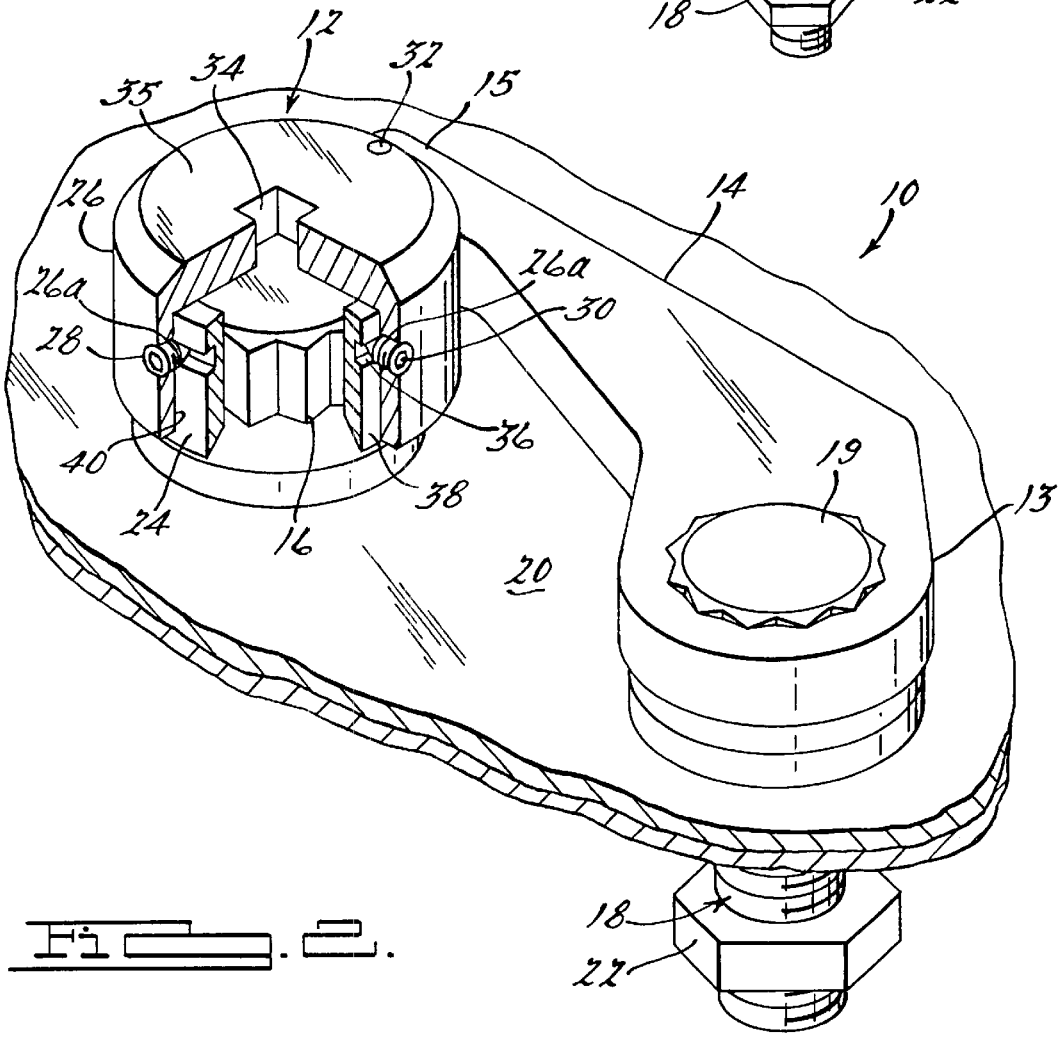
FIG. 2 is a perspective, cut-away view of a reaction cam of the present invention showing the reaction cam being used with a conventional backup wrench to provide a reaction force.

Referring now to FIG. 2, a reaction cam 12 in accordance with a preferred embodiment of the present invention is shown with the backup wrench 14. In the preferred embodiment, the reaction cam 12 is used with an adjacent component 16 which is located in close proximity to fastener 18. Merely by way of example, adjacent component 16 may comprise a bolt. Fastener 18 and adjacent component 16 are typically secured to a common surface 20, although they do not necessarily need to be. The fastener 18 and adjacent component 16 can be disposed in different surfaces if still located proximate to each other. The nut 22 is threadably coupled to a threaded shaft of fastener 18 opposite the fastener head 19.

With continued reference to FIG. 2, reaction cam 12 includes an inner sleeve 24 and a cam housing 26. The inner sleeve 24 is adapted to fit over the head of adjacent component 16 and the cam housing 26 fits over the inner sleeve 24 and rotates about the inner sleeve 24. However, it should be appreciated that the inner sleeve 24 can be sized and shaped to fit over a variety of sized and shaped objects such as, but not limited to, an end of a pipe, a flange or a fastener. In the preferred embodiment, two retaining set screws 28,30 are threadably inserted into threaded openings 26*a* in the cam housing 26 and engage within a groove 36 formed in an exterior surface 38 of the inner sleeve 24 to retain the inner sleeve 24 to the cam housing 26 while still permitting rotational movement of the inner sleeve 24 relative to cam housing 26. The retaining set screws 28,30 are preferably located at least about 45° from each other.

Figure 5:
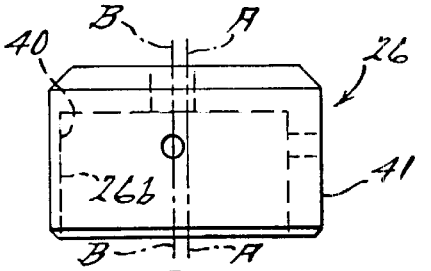
FIG. 5 is a side view of an outer sleeve of the reaction cam of FIG. 2.
Figure 6:
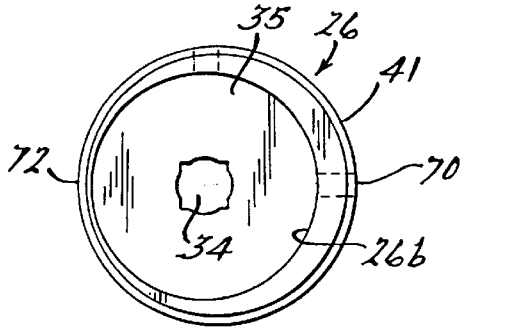
FIG. 6 is a top view of the reaction cam of FIG. 2.

With reference to FIGS. 5 and 6, the cam housing 26 is bored or otherwise manufactured to form a circular recess or opening 26*b* which receives the inner sleeve 24. The cam housing 26 is preferably formed off-center (i.e., eccentric) from a center axis, indicated by line A—A, of the cam housing 26, thereby forming a high point 70 and a low point 72 of the cam housing 26. The cam housing 26 is preferably formed about 0.125 inch off-center. The high point 70 or "contact point" of cam housing 26 is formed by the distance from the coaxial center of the circular recess 26*b*, indicated by line B—B, to the cam housing exterior surface 41.

Figure 3:
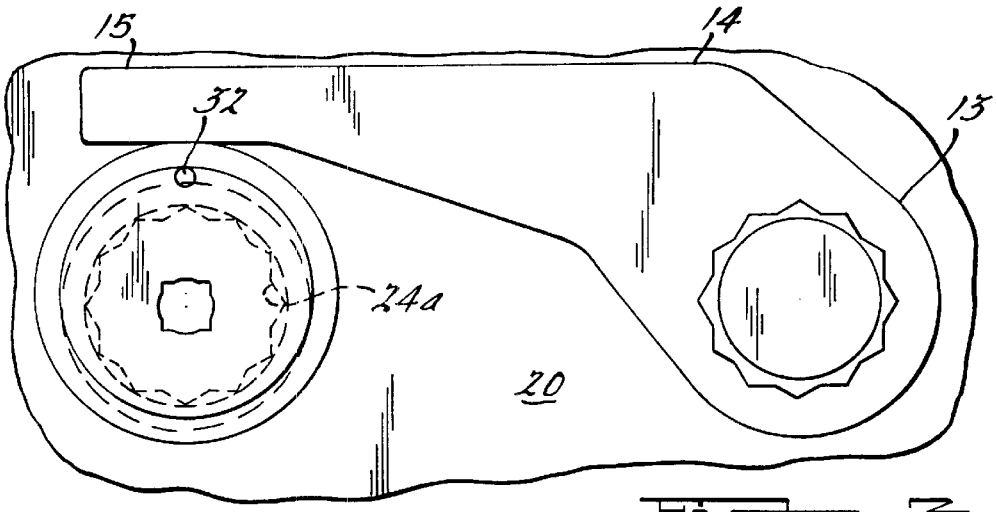
FIG. 3 is a plan view of the reaction cam and backup wrench shown in FIG. 2 wherein the reaction cam is rotated to a loaded position.
Figure 4:
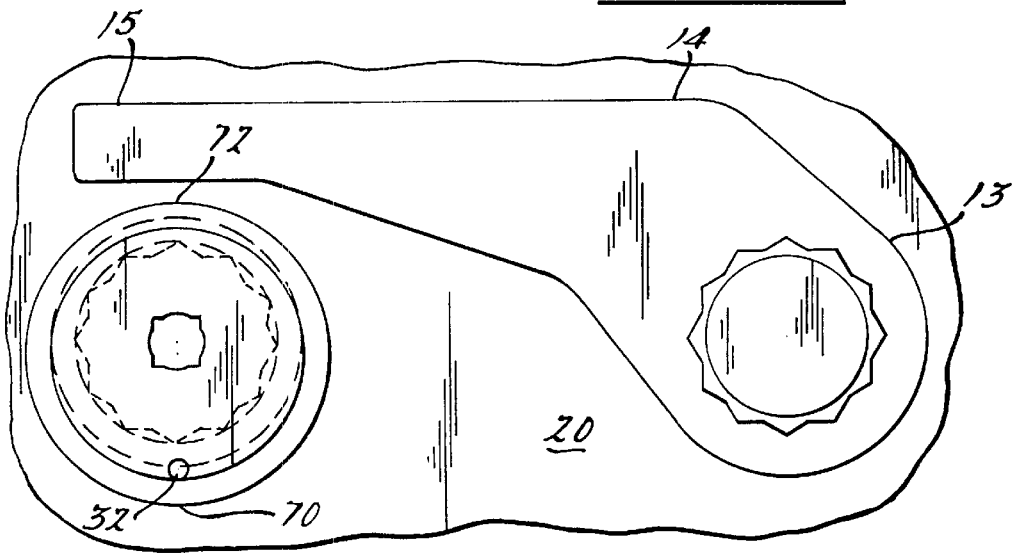
FIG. 4 is a plan view of the reaction cam and backup wrench of FIG. 2 wherein the reaction cam has been rotated to an unloaded position.

As shown in FIGS. 3 and 6, the high point 70 or "contact point" is the desired point on the cam housing 26 which should be aligned to abut the backup wrench 14 prior to the torquing process. As illustrated in FIG. 5, the low point 72 or "no contact point" of cam housing 26 is formed by the smallest distance from the recess 26*b* center axis, indicated by line B—B, to the cam housing exterior surface 41. As shown in FIG. 4, the low point 72 or "no contact point" is the point which needs to be facing the second end 15 of the backup wrench 14 to permit removal of the reaction cam 12 after the backup wrench 14 has been loaded during the torquing process.

With reference to FIG. 6, the cam housing 26 has a drive opening 34 disposed within cam housing head 35 and centered about the center axis indicated by line A—A in FIG. 5. The drive opening 34 is preferably a square shaped opening and allows the cam housing 26 to be rotated about the inner sleeve 24 with a standard one-half inch drive socket wrench well-known in the art. This allows a standard socket wrench (not shown) to be used to rotate the cam housing 26.

Figure 7:
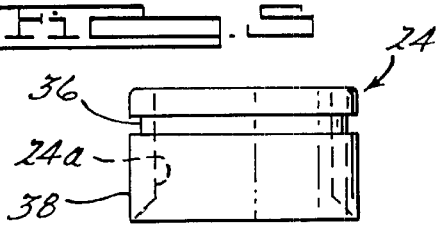
FIG. 7 is a side view of the inner sleeve of the reaction cam of FIG. 2.

The inner sleeve 24 is illustrated in FIGS. 2, 3 and 7. Inner sleeve 24 has an opening 24*a* which is sized and shaped to securely fit over the head of adjacent component 16. In the preferred embodiment, the channel 36 is formed about preferably the entire circumference of the inner sleeve exterior surface 38. Channel 36 has a suitable width and depth for receiving retaining set screws 28 and 30 such that the cam housing is movably coupled to the inner sleeve 24, and can rotate freely about inner sleeve 24 while still preventing the inner sleeve 24 and cam housing 26 from separating apart when the reaction cam 12 is removed from the adjacent component 16. It should also be appreciated that the retaining set screws 28 and 30 could otherwise be fixably coupled to the inner sleeve exterior surface 38 and the channel 36 could be disposed on a cam housing interior surface 40. The inner sleeve 24 is preferably made of a material that resists wear. One preferred material is heat treated steel.

In FIGS. 2–4,a marking 32 indicates the high point 70 or "contact point" to allow the user to easily align the reaction cam 12 with the backup wrench 14 before the reaction cam 12 is acted upon by the backup wrench 14 during the torquing process. The marking 32 is located on cam housing exterior surface 41 adjacent the high point 70. The cam housing 26 is preferably made of a material which has great wear resistance. One preferred material is heat treated steel, and if weight is a concern, another preferred material is aluminum.

Referring to FIG. 3, prior to loading, the first end 13 of backup wrench 14 is fixably coupled to the fastener head 19, and the reaction cam 12 is placed on the adjacent component 16 and aligned such that the second end 15 of the backup wrench 14 abuts the high point at marking 32 of reaction cam 12. As nut 22 is torqued by an external torque wrench (not shown) to a desired tightness, a reaction force is applied by the reaction cam 12 to the backup wrench 14 as the backup wrench 14 retains the fastener 18 in a fixed position to prevent rotation. This reaction force counteracts the force exerted by backup wrench 14. Once the nut 22 has been sufficiently torqued, the torque applied to the nut 22 is removed. A tool (not shown) is then coupled to drive opening 34 to easily rotate the cam housing 26 to the unloaded position. One preferred tool is a standard socket wrench.

With reference to FIG. 4, the unloaded position occurs when the cam housing 26 is rotated such that the low point 72 is located proximate to the backup wrench. In the preferred embodiment, the cam housing 26 is rotated approximately 180° from the initial position it was in during the torquing process. Once the cam housing 26 is rotated to this position, a gap is created between the second end 15 of the backup wrench 14 and the cam housing 26, which removes the load being applied to the cam housing 26 by the backup wrench 14. The reaction cam 12 can then be easily removed from the adjacent component 16. The reaction cam 12 is removed from the adjacent component 16 in one piece without the cam housing 26 separating from the inner sleeve 24 because the retainer set screws 28 and 36 secure the cam housing 26 to the inner sleeve 24. Therefore, there are no parts of the reaction cam 12 which can be accidentally lost in the work environment in which it is used.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A reaction cam system for use in a release system having a backup wrench coupled to a first portion of a fastener, where the backup wrench is intended to abut an adjacent component, the reaction cam system comprising:

an inner sleeve removably coupled to said adjacent component;

a cam housing rotationally coupled to said inner sleeve so as to be movable eccentrically relative to the inner sleeve;

said cam housing being positioned in a first position prior to a torquing operation to provide a reaction force to said backup wrench while a torque is applied to a second portion of said fastener; and said cam housing being movable to a second position after said torque is removed from said second portion of said fastener, wherein said cam housing is moved out of contact with said backup wrench, thereby enabling said reaction cam system to be easily removed from said adjacent component and said backup wrench from said fastener.

2. The reaction cam system of claim 1, wherein said cam housing includes a recess formed offset from a center axis of said cam housing whereby a high point and a low point are effectively formed on said cam housing.

3. The reaction cam system of claim 2, wherein said high point is located approximately 180° from said low point.

4. The reaction cam system of claim 2, further including a mark for indicating said high point, said mark located on an exterior surface of said cam housing and juxtaposed to said high point.

5. The reaction cam system of claim 1, further including at least one set screw for rotatably coupling said cam housing to said inner sleeve.

6. The reaction cam system of claim 5, further including a channel disposed on an outer surface of said inner sleeve, said set screw being engaged with said channel.

7. The reaction cam system of claim 1, further including a drive opening for engaging with a tool thereby enabling rotation of said cam housing about said inner sleeve by said socket wrench, said drive opening disposed on a head of said cam housing.

8. The reaction cam system of claim 7, wherein said drive opening is shaped to receive a drive element of a socket wrench.

9. A reaction cam system for use in a release system having a backup wrench coupled to a first portion of a fastener, where the backup wrench is intended to abut an adjacent component, the reaction cam system comprising:

an inner sleeve removably coupled to said adjacent component;

a cam housing rotationally coupled to said inner sleeve so as to be movable eccentrically relative to said inner sleeve but not separable from said inner sleeve;

said cam housing being positioned in a first position prior to a torquing operation to provide a reaction force to said backup wrench while a torque is applied to a second portion of said fastener; and said cam housing being movable to a second position after said torque is removed from said second portion of said fastener, wherein said cam housing is moved out of contact with said backup wrench, thereby enabling said reaction cam system to be easily removed from said adjacent component and said backup wrench removed from said fastener; and wherein said cam housing includes a drive structure for enabling an external tool to be used to rotate said cam housing.

10. The reaction cam system of claim 9, wherein said cam housing has a recess formed offset from a center point of said cam housing, whereby a high point and a low point are formed on said cam housing.

11. The reaction cam system of claim 10, wherein said high point is located from 0° to 180° from said low point.

12. The reaction cam system of claim 10, further including a mark for indicating said high point, said mark located on an exterior surface of said cam housing and juxtaposed to said high point.

13. The reaction cam system of claim 10, wherein said drive structure comprises a drive opening.

14. A method for releasing reaction forces which develop between a backup wrench and an adjacent component during a torquing process, wherein the torquing process involves using the backup wrench to hold one component of a fastener stationary while a torque is applied to a second component of the fastener, the method comprising the steps of:

removably coupling an inner sleeve to said adjacent component;

rotatably coupling a cam housing to said inner sleeve, wherein the cam housing moves eccentrically relative to the inner sleeve;

coupling said backup wrench to said fastener, whereby said backup wrench is adjustably supported against said cam housing;

applying a torque to said one component of said fastener, whereby said backup wrench retains said second component of said fastener in a fixed position and applies a load to said cam housing;

removing said torque;

rotating said cam housing to an unloaded position whereby said load is removed from said cam housing; and removing said cam housing and said inner sleeve from said adjacent component.

* * * * *